US006298613B1

(12) United States Patent
Coulton et al.

(10) Patent No.: US 6,298,613 B1
(45) Date of Patent: Oct. 9, 2001

(54) ROOF RIDGE VENT HAVING A REINFORCED NAIL LINE

(75) Inventors: Michael S. Coulton, Lansdale; Joseph Opdyke, Collegeville, both of PA (US)

(73) Assignee: Benjamin Obdyke, Inc., Horsham, PA (US)

( * ) Notice: Subject to any disclaimer, the term of this patent is extended or adjusted under 35 U.S.C. 154(b) by 0 days.

(21) Appl. No.: 09/500,848

(22) Filed: Feb. 10, 2000

(51) Int. Cl.[7] ..... E04H 12/28

(52) U.S. Cl. ..... 52/199; 52/198; 52/57; 52/96; 454/365; 454/366

(58) Field of Search ..... 52/198, 199, 95, 52/96, 57, 302.1; 454/365, 366

(56) References Cited

U.S. PATENT DOCUMENTS

| | | | |
|---|---|---|---|
| 1,717,728 | | 6/1929 | Moore . |
| 2,200,031 | | 5/1940 | Lee . |
| 2,214,183 | | 9/1940 | Seymour . |
| 2,704,500 | | 3/1955 | Bonforte . |
| 2,799,214 | | 7/1957 | Roose . |
| 2,868,104 | | 1/1959 | Honholt et al. . |
| 3,185,070 | | 5/1965 | Smith . |
| 3,236,170 | | 2/1966 | Meyer et al. . |
| 3,311,047 | | 3/1967 | Smith et al. . |
| 3,481,263 | | 12/1969 | Belden . |
| 3,660,955 | | 5/1972 | Simon . |
| 3,949,657 | | 4/1976 | Sells . |
| 4,280,399 | | 7/1981 | Cunning . |
| 4,325,290 | | 4/1982 | Wolfert . |
| 4,554,862 | | 11/1985 | Wolfert . |
| 4,876,950 | | 10/1989 | Rudeen . |
| 4,903,445 | | 2/1990 | Mankowski . |
| 4,942,699 | | 7/1990 | Spinelli . |
| 4,957,037 | | 9/1990 | Tubbesing et al. . |
| 4,962,692 | | 10/1990 | Shuert . |
| 5,094,041 | | 3/1992 | Kasner et al. . |
| 5,122,095 | | 6/1992 | Wolfert . |
| 5,167,579 | | 12/1992 | Rotter . |
| 5,174,076 | | 12/1992 | Schiedegger et al. . |
| 5,288,269 | | 2/1994 | Hansen . |
| 5,425,672 | | 6/1995 | Rotter . |
| 5,651,734 | | 7/1997 | Morris . |
| 5,673,521 | | 10/1997 | Coulton et al. . |
| 5,826,383 | * | 10/1998 | Garrison ..... 52/198 |
| 5,830,059 | * | 11/1998 | Sells ..... 454/365 |
| 5,867,956 | * | 2/1999 | Gregory, Jr. et al. ..... 52/309.13 |
| 5,902,432 | | 5/1999 | Coulton et al. . |
| 5,960,595 | | 10/1999 | McCorsley, III et al. . |
| 6,079,166 | * | 6/2000 | Mason et al. ..... 52/198 |
| 6,125,602 | * | 10/2000 | Freiborg et al. ..... 52/560 |
| 6,131,353 | * | 10/2000 | Egan ..... 52/408 |

OTHER PUBLICATIONS

Assignee's Co–pending U.S. Patent Application No. 09/480,385 filed Jan. 10, 2000.

* cited by examiner

*Primary Examiner*—Yvonne M. Horton
(74) *Attorney, Agent, or Firm*—Howson and Howson

(57) ABSTRACT

A roll-form roof ridge vent having a plurality of hollow cusps and a reinforced nail line. The cusps space the upper surface of the vent from the underlying roof to provide a path of ventilation therebetween. The reinforced nail line permits the use of standard pneumatic roofing nail guns to apply nails to the vent and overlying cap shingles. The reinforced vent resists compression and prevents nail heads of nails driven into hollow cusps of the vent from sinking past the upper surface of the vent. The nail line reinforcement material can be a fabric, elastomeric or other type of material.

18 Claims, 2 Drawing Sheets

ROOF RIDGE VENT HAVING A REINFORCED NAIL LINE

FIELD OF THE INVENTION

The present invention relates to a roof ridge vent for use in building construction to enhance the circulation of air in a space between the roof and an underlying ceiling structure, and more particularly, the present invention relates to a roll-form roof ridge vent which has a reinforced nail line area so that the vent and/or overlying shingles are not damaged when installed with nails applied with a standard pneumatic roofing nail gun.

BACKGROUND OF THE INVENTION

It is useful, and in many locales a building code requirement, that the attic area of a building be provided with a means to permit air exchange. Such ventilation prevents undue heat buildup, which can render the living quarters of the building uncomfortable and impose unreasonable energy requirements for cooling. Proper ventilation of the attic area also tends to preserve the structural integrity of the roof and roof coverings. One method of venting the roof structure consists of applying a venting media over a slot present along the ridge of a roof. These types of vents are known as ridge vents.

An example of a roof ridge vent is provided by U.S. Pat. No. 5,960,595 issued to McCorsley et al. and co-owned by the assignee of the present application. The '595 patent discloses a roof ridge vent comprising a continuous, indeterminate-length, roll-form, openwork web, or mat, of randomly convoluted polymeric filaments. The mat is capable of being rolled lengthwise in a spiral roll after or during manufacture and unrolled lengthwise during installation on the roof ridge. A plurality of cusps, or hollow spacer elements, project from the upper face of the mat so that, when the apex portions of the cusps confront the roof surface, the upper face of the mat is spaced from the roof surface thereby creating a path for air flow between the shingles overlying the upper face of the vent and the underlying roof. A continuous air permeable fabric backing is thermally bonded to the cusps of the mat to prevent weather and insect infiltration into the attic space.

Other rollable ventilation products are known. U.S. Pat. No. 5,673,521 which issued to Coulton et al. and which is owned by the assignee of the present application discloses a roof ridge vent comprising a continuous, indeterminate-length, single sheet, roll-formed web of thermoformable material. U.S. Pat. No. 4,942,699, which issued to Spinelli and which is owned by the assignee of the present application, and the embodiment illustrated in FIG. 5 of U.S. Pat. No. 5,425,672, which issued to Rotter, disclose indeterminate-length, roll-form ventilation products made of matting material which are installed overlying roof ridges and which support a row of overlying cap shingles.

U.S. Pat. No. 5,651,734 issued to Morris discloses a roll-form roof ridge ventilator made of a longitudinal blank of scored corrugated plastic sheet material. The vent is installed by unrolling the sheet material on a roof, folding the vent upon itself at scored lines, and securing the folded sections of the vent to the roof ridge. The embodiment illustrated in FIG. 12 of U.S. Pat. No. 3,660,955 issued to Simon discloses an indeterminate-length, roll-form web of plastic sheet material which has a plurality of spacer elements and which is unrolled and installed between rows of overlapping shingles to provide air passageways therebetween.

Roll-form roof ridge vents provide many advantages relative to non-roll-form, sectional roof ridge vent products. Roll-form vents are less costly to manufacture, facilitate efficient storage and transportation, and involve less labor costs to install. The roll form vents are installed as a continuous vent structure along the entire length of the roof ridge; while, sectional vents may require four or more separate sections to be installed in an end-to-end overlapping relation. Examples of sectional roof ridge vents are provided by U.S. Pat. Nos.: U.S. Pat. No. 1,717,728 issued to Moore; U.S. Pat. No. 2,200,031 issued to Lee; U.S. Pat. No. 2,214,183 issued to Seymour; U.S. Pat. No. 2,704,500 issued to Bonforte; U.S. Pat. No. 2,868,104 issued to Honholt et al.; U.S. Pat. No. 2,799,214 issued to Roose; U.S. Pat. No. 3,185,070 issued to Smith; U.S. Pat. No. 3,236,170 issued to Meyer et al.; U.S. Pat. No. 3,311,047 issued to Smith et al.; U.S. Pat. No. 3,481,263 issued to Belden; U.S. Pat. No. 3,949,657 issued to Sells; U.S. Pat. No. 4,280,399 issued to Cunning; U.S. Pat. Nos. 4,325,290, 4,554,862 and 5,122,095 issued to Wolfert; U.S. Pat. No. 4,876,950 issued to Rudeen; U.S. Pat. No. 4,903,445 issued to Mankowski; U.S. Pat. No. 4,957,037 issued to Tubbesing et al.; U.S. Pat. No. 4,962,692 issued to Shuert; U.S. Pat. No. 5,094,041 issued to Kasner et al.; U.S. Pat. No. 5,167,579 issued to Rotter; U.S. Pat. No. 5,174,076 issued to Schiedegger et al.; and U.S. Pat. No. 5,288,269 issued to Hansen.

In some situations, known roll-form roof ridge vents, specifically those made of an openwork mat, cannot be installed properly with the use of standard pneumatic nail guns used by roofers. The force of a nail fired by a standard roofing nail gun can cause the mat to compress adjacent the nail location. This reduces ventilation air flow and provides an uneven upper vent surface causing a displeasing aesthetic effect. In addition, if a nail used to secure an overlying cap shingle is driven into a hollow portion of a cusp of the mat, the nail head can be driven entirely through the upper face of the mat. In the latter situation, a piece of the overlying cap shingle can break off and be driven with the nail head deep into the vent creating a path for weather and insect infiltration.

Therefore, while the roll-form and sectional roof ridge vents disclosed in the above referenced patents may function satisfactorily under certain circumstances, there is a need for an improved roof ridge vent which provides all the above stated advantages of a roll-form vent while being capable of being properly and readily installed with the use of a standard pneumatic nail gun. The nail line and adjacent area of the vent should be reinforced to prevent unwanted compression of the vent and prevent the head of a nail from being driven past the upper face of the vent. In addition, the vent should be capable of being manufactured efficiently and formed into a roll for shipping, transportation and subsequent installation.

OBJECTS OF THE INVENTION

With the foregoing in mind, a primary object of the present invention is to provide an efficient and economical roof vent which is capable of being readily and properly installed in a manner requiring labor skills possessed by the average roof installer.

Another object of the present invention is to provide a roof ridge vent which permits use of standard pneumatic roofing nail guns to properly secure the vent and overlying shingles to the roof.

A further object of the present invention is to provide a roof ridge vent which has a low height profile and which provides an accepted amount of air venting capacity.

A still further object of the present invention is to provide a roof ridge vent which is made as a continuous, indeterminate-length mat/web which can be stored, transported and supplied to installers in roll-form.

A still further object of the present invention is to provide a roll-form roof ridge vent which is efficiently manufactured and which is efficiently bonded to strips of air permeable filter material and nail line reinforcement material.

SUMMARY OF THE INVENTION

More specifically, the present invention provides a roof ridge vent for installation overlying an open roof ridge to provide ventilation to a space beneath a roof. The vent is constructed as a continuous, indeterminate-length, roll-form mat, or web, which is rolled lengthwise into a spiral roll during and/or after manufacture and unrolled lengthwise in a substantially straight direction during installation on the roof ridge. Thus, when installed, the mat forms a continuous, one-piece roof ridge vent along the entire roof ridge.

The mat includes an upper face and a plurality of spaced apart cusps, or spacer elements, projecting downwardly from the upper face. The upper face is substantially planar in an unrolled and uninstalled condition, and each of the cusps have a base portion coplanar with the upper face and an apex portion a spaced distance therefrom. Thus, when the vent is installed, the apex portion of the cusps confront the roof and space the upper face of the mat from the roof to provide a path of ventilation through the mat from an opening in the roof ridge to the outside environment.

A strip of nail line reinforcement material is bonded to at least a portion of the upper face of the mat adjacent the nail lines identified on the vent. The reinforced nail line area permits the vent and overlying shingles to be installed on the roof with standard roofing nail guns without causing unwanted mat compression and without permitting nail heads from becoming over-driven into the vent.

According to the preferred embodiment of the present invention, the mat is an openwork mat made from randomly convoluted polymeric filaments as disclosed in U.S. Pat. No. 5,960,595. The nail line reinforcement material can be a fabric material, an elastomeric material or other material. In one contemplated embodiment, the same type of material utilized as the nail line reinforcement material can also be utilized on the roof confronting side of the vent for weather and insect infiltration prevention purposes.

BRIEF DESCRIPTION OF THE DRAWINGS

The foregoing and other objects, features and advantages of the present invention should become apparent from the following description when taken in conjunction with the accompanying drawings, in which.

DETAILED DESCRIPTION OF THE PREFERRED EMBODIMENT

Figure 2:
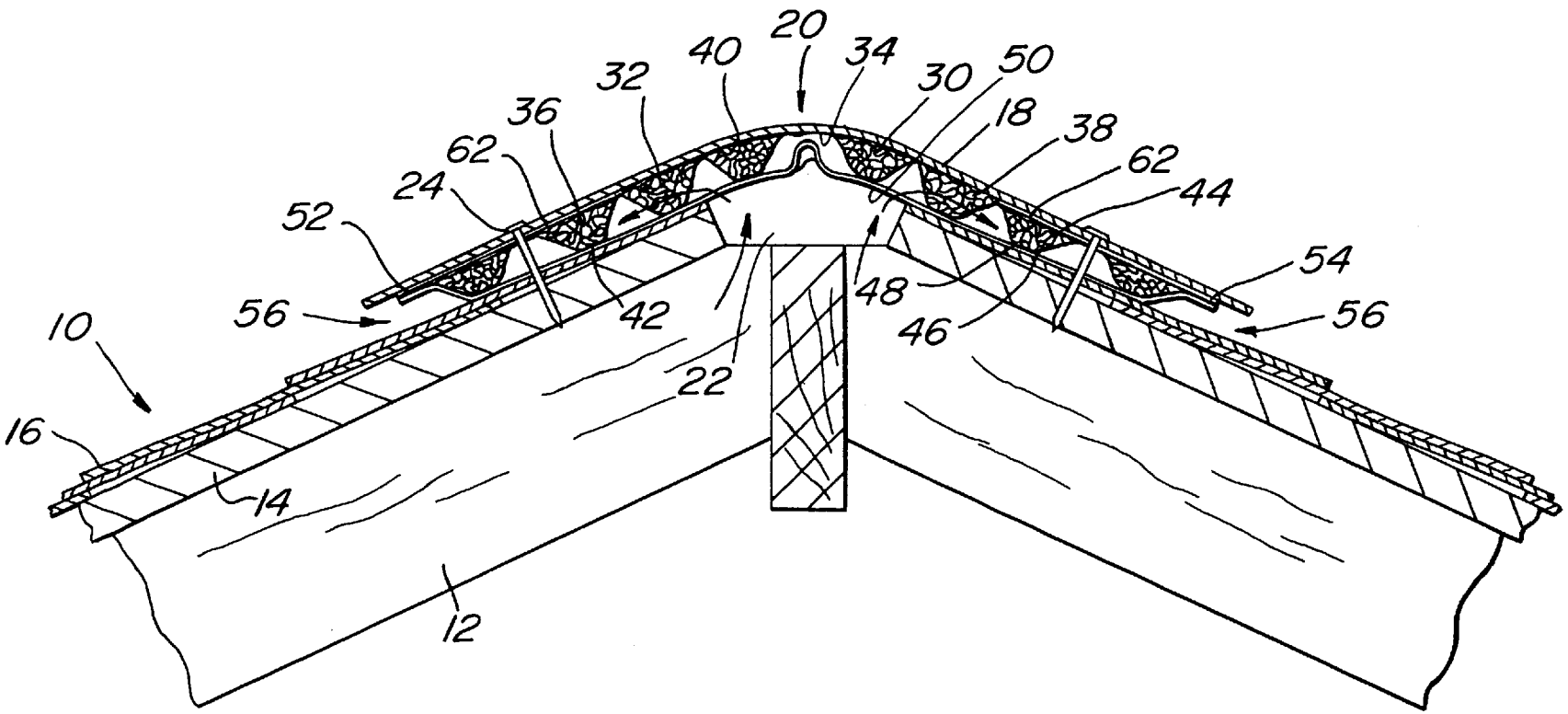
FIG. 2 is an elevational cross sectional view of the roof ridge vent of FIG. 1 installed on a roof ridge.

Referring now to the drawings, FIG. 2 illustrates a roof 10 having a typical construction which utilizes a roof ridge vent 30. The roof 10 is constructed from a plurality of rafters 12 supported at their lower ends by front and rear walls (not shown) of the building. A roof deck 14 is typically constructed of plywood, or other suitable panels, to provide an outer sheathing of the building. The roof deck 14 is secured to the rafters 12 and extends to the end walls.

Shingles 16 are secured to the roof deck 14, typically with nails, to finish sloping portions of the roof 10 in accordance with conventional construction practices. Conventional cap shingles 18 are installed in overlapping fashion to cover the roof ridge, or peak, 20. A slot 22 is provided along the length of the roof ridge 20 of the exemplified roof 10 to provide a passageway for venting air between the underlying attic area and the ambient atmosphere.

In accordance with the present invention, as will be filly discussed, a vent 30 is interposed between the cap shingles 18 and the underlying portions of the roof 10. The vent 30 is a roll-form type product which is rolled lengthwise into a spiral roll during manufacture and which is stored, transported and supplied to installers in roll-form. As with other known roll-form ventilation products, the vent 30 is unrolled lengthwise on the roof 10; positioned overlying the roof ridge 20; and secured to the roof 10 with nails 24, or the like, along nail lines identified on the vent 30. Thus, the vent 30 provides a continuous, one-piece ventilation product which extends in a substantially straight direction and which is relatively simple to install.

Figure 1:
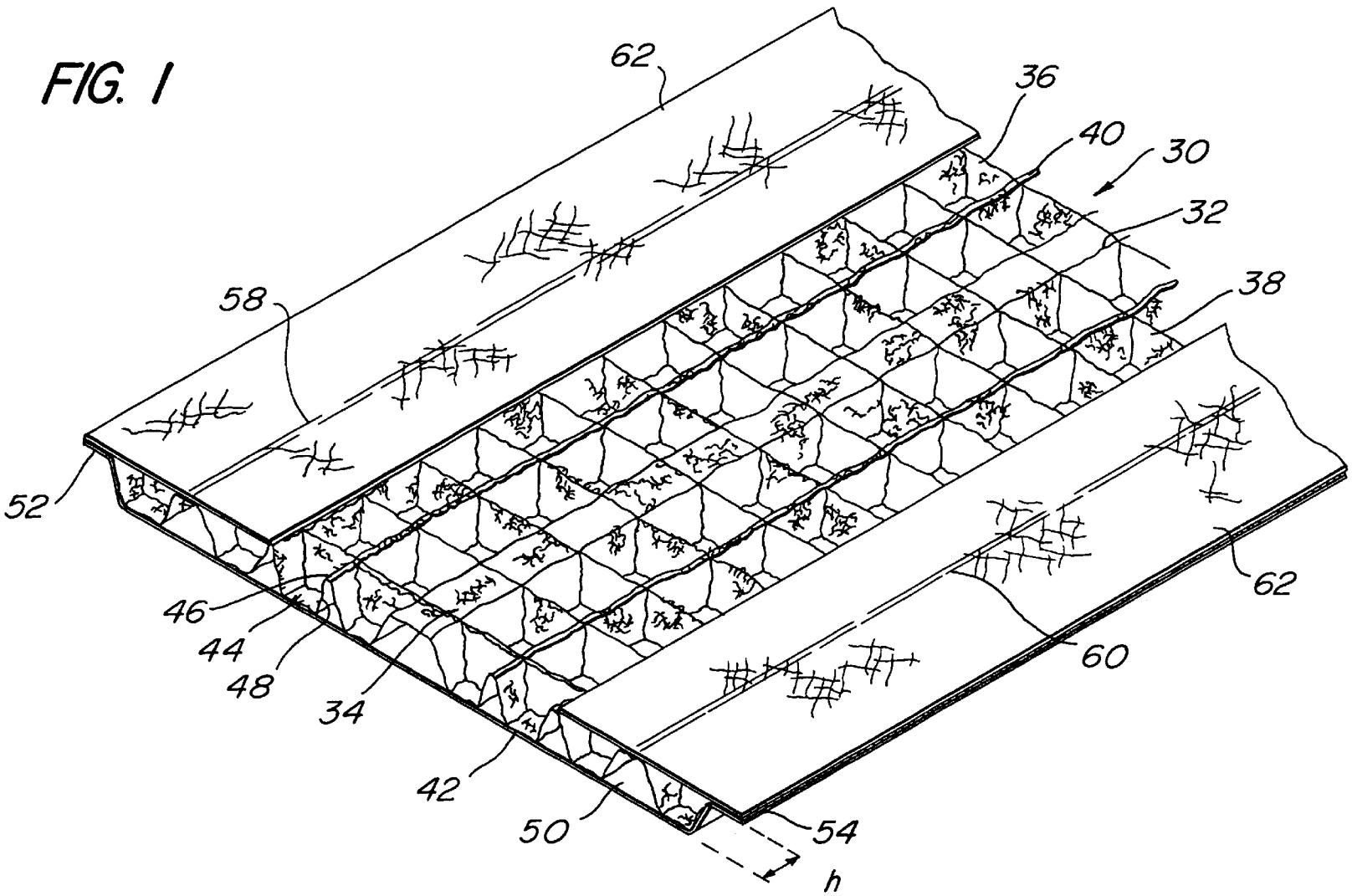
FIG. 1 is a perspective view of an unrolled roof ridge vent embodying the present invention.

The preferred embodiment of vent 30 of the present application, which is illustrated in FIGS. 1 and 2, has some similarities with the previously referenced roll-form vent disclosed in U.S. Pat. No. 5,960,595, the disclosure of which is incorporated herein by reference. For instance, the vent 30 is preferably formed as an indeterminate-length, single-sheet, openwork mat, or web, 32 of randomly convoluted polymeric filaments. The mat 32 has a longitudinal medial hinge, or centerline, 34 dividing the mat 32 into a pair of identical longitudinally-extending lateral flaps, or side portions, 36 and 38, which, during installation, are capable of being disposed at a dihedral angle relative to one another. Thus, as illustrated in FIG. 2, the installed mat 32 conforms to the surface of the roof ridge and has an inverted V-shaped transverse cross-section.

After being unrolled and before being installed, the mat 32 has a substantially planar upper surface 40 and a substantially planar roof confronting surface 42. See FIG. 1. A plurality of cusps, or hollow spacer elements, 44 are disposed in a plurality of longitudinal rows extending throughout the lateral flaps 36 and 38. Each cusp 44 projects downwardly from the upper face 40 and has a base portion 46 coplanar with the upper face 40 and an apex portion 48 a spaced distance therefrom. The apex portions 48 form the roof confronting surface 42 of the mat 32.

When the vent 30 is installed, as illustrated in FIG. 2, the upper face 40 of the mat 32 confronts the overlying cap shingles 18, and the apex portions 48 of the cusps 44 engage the underlying roof 10. The cusps 44 space the face 40 of the mat 32 from the roof 10 to provide ventilation passageways therebetween. The layout, or pattern, of the cusps 44 is particularly designed to resist compression of the vent 30 during and after installation and to afford ready rolling and unrolling during manufacture and installation.

A strip of air permeable filter material 50 is secured to the roof confronting surface 42 of the mat 32. The filter 50 permits air to flow outwardly in the manner illustrated by the arrows in FIG. 2, while preventing insects, rain, snow, blowing foreign objects, and the like from entering in the opposite direction. Preferably, as illustrated in FIGS. 1 and 2, a continuous length of filter material 50 is thermally or adhesively bonded to the apex portions 48 of the cusps 44 and extends to the edge flanges 52, 54 of the lateral flaps 36, 38. Since the edge flanges 52, 54 are substantially co-planar with the upper surface 40 of the mat 32, weather and insects are blocked from entering into the vent adjacent the vent opening 56 formed between the roof 10 and the cap shingles 18. The filter material 50 also extends over and covers the slot 22 so that insects or like foreign objects cannot enter the vent 30 through the slot 22 which is in communication with the attic space of the building. Preferably, the filter material 50 is a sheet-like fabric, such as, non-woven nylon polyester. Alternatively, the filter media 50 could be formed of needle-punched non-woven material, metal mesh screens, or like structures which provide air permeability through small spaces in their structure.

One of the novel aspects of the present invention is that the upper surface 40 of the mat 32 is reinforced adjacent the nail lines 58, 60 identified on the vent 30. A single nail line 58, 60 extends in a longitudinal direction on each lateral flap 36, 38 and is located spaced distances from the centerline hinge 34 and edge flanges 52, 54. As illustrated, one or more rows of cusps 44 extend between each nail line 58, 60 and the centerline hinge 34 and each nail line 58, 60 and the edge flanges 52, 54.

Preferably, the mat 32 is reinforced with one or more strips of nail line reinforcement material 62 bonded to the upper surface 40 of the mat 32 over the suggested nail lines 58, 60 and surrounding area including at least the rows of cusps 44 which are adjacent to the nail lines 58, 60. The reinforced mat 32 resists compression because the force applied to the vent 30 by the nail 24 is transferred by the reinforcement material 62 across a large area of the mat 32 and is thereby efficiently absorbed by the mat 32. This is true whether or not a roofing nail gun is utilized to apply the nail. In addition, when the cap shingles 18 are nailed to the roof 10 and vent 30, the reinforcement material 62 prevents nail heads of nails driven into hollow cusp areas of the mat from passing beyond the upper surface 40 of the mat 32. Thus, this permits the use of pneumatic roofing nail guns to drive the nails into the cap shingles 18, vent 30 and roof 10.

As illustrated in FIG. 1, the nail line 58, 60 on each lateral flap 36, 38 is covered by a separate strip of reinforcement material 62 which extends over the nail line 58, 60 and the adjacent row of cusps 44 on either side of the nail line 58, 60. Alternatively, each of the reinforcement strips could cover a greater portion of the upper surface of the mat, or one strip could be utilized to cover substantially the entire upper surface of the mat. However, in the preferred embodiment, the centerline hinge 34 remains exposed so that the reinforcement strips 62 do not limit the flexibility of the hinge 34.

The nail line reinforcement material 62 can be a sheet-like fabric material, such as non-woven nylon polyester, or an elastomeric material. In addition, other reinforcement materials could also be selected and utilized. For instance, the same type of material utilized as the filter material 50 can be utilized as the nail line reinforcement material 62. Thus, one contemplated alternative is to utilize a single sheet of material which covers the entire roof confronting surface 42 of the mat 32, which is folded over the edge flanges 52, 54, and which is bonded to the upper surface 40 of the mat 32 so that it covers both nail lines 58, 60. Another alternative is to utilize two separate strips of material each of which is folded over one of the edge flanges and is bonded to appropriate adjacent portions of the roof confronting surface and upper surface of the mat. In any of these alternatives, portions of one, or both, of the fabric materials can be provided with a visually perceptible indicator (not shown) that readily identifies the roof confronting side 42 of the vent 30 from the upper side 40 of the vent 30. To this end, the fabrics, or portions thereof could be dyed different colors, could contain stripes, or could simply be marked with appropriate wording.

A moisture impermeable elastomeric material can be utilized as the nail line reinforcement material to provide a barrier to water infiltration. To this end, the entire upper surface of the mat can be covered with an elastomeric material to reinforce the nail line and to prevent water infiltration in the event that a cap shingle, or several cap shingles, become dislodged by bad weather and wind conditions. The exposed elastomeric material is capable of preventing rain or the like from passing through the vent and entering the opening in the roof ridge. In addition, the elastic property of such a material permits the material to extend across the centerline hinge without restricting the ability of the hinge to flex so that the vent can properly conform to the pitch of the roof ridge.

Another important aspect of the vent 30 according to the present invention is that it is provided with a sufficiently low profile, or height, so that commercially available standard-size pneumatic roofing nail guns can be utilized to nail the vent 30 to the roof 10. Standard nail guns are limited to use with nails no greater than about 1.75 inches, and the nails must extend a sufficient distance into the roof decking 14 for the nails to meet roofing installation requirements. Thus, if the vent has too great a thickness, or height, nail guns cannot be used because the nails do not embed far enough into the roof decking. The vent 30 of the present invention is provided with a height "h" of about ⅝ of an inch. Tests have shown that standard nail guns can be utilized to properly install a vent having the above referenced height. A vent having the stated height can provide approximately twelve square inches of net free ventilation area per linear foot of product which is within industry ventilation standards.

By way of example, and not by way of limitation, the vent 30 is made of an openwork mat of randomly convoluted polymeric filaments. The vent 30 has a width of about 10.5 inches and a thickness of about ⅝ of an inch. Four longitudinally extending rows of cusps 44 are located on each lateral flap 36, 38, and one row of cusps 44 extends between the nail line 58, 60 and edge flange 52, 54 on each lateral flap 36, 38. Approximately ninety six cusps in total are provided on each linear foot of the vent. The filter material 50 extends continuously on the roof confronting surface 42 of the mat 32 and spans the entire distance between the edge flanges 52, 54. The vent has two strips of nail line reinforcement material 62 each of which has a width of approximately three inches and covers the nail line 58, 60 and two rows of cusps, one on either side of the nail line 58, 60.

The above-described roof ridge vent according to the present invention provides a roll-form vent which is easy to install, inexpensive to manufacture, and enables use of standard pneumatic roofing nail guns.

While a preferred ridge roof vent has been described in detail, various modifications, alterations, and changes may be made without departing from the spirit and scope of the vent according to the present invention as defined in the appended claims.

What is claimed is:

1. A roof ridge vent, comprising:

a continuous, indeterminate length, mat having and a plurality of spaced apart cusps projecting downwardly from said upper face, said upper face being substantially planar in an unrolled and uninstalled condition, said mat being an openwork mat made of a plurality of randomly convoluted polymeric filaments, each of said cusps having a base portion coplanar with said upper face and an apex portion a spaced distance therefrom, said apex portions of said cusps forming a lower face of said mat opposite said upper face, said lower face being adapted to confront a roof ridge surface and said upper face being adapted to confront cap shingles overlying said vent;

a strip of nail line reinforcement material bonded to at least a portion of said upper face of said mat; and an air permeable filter material bonded to said lower face of said mat for preventing weather and insect infiltration through said vent;

whereby, when installed, said vent provides a path or ventilation through said air permeable filter material and between said upper and lower faces of said mat from an opening in the roof ridge to the outside environment.

2. A roof ridge vent according to claim 1, wherein said nail line reinforcement material is a fabric material.

3. A roof ridge vent according to claim 1, wherein said nail line reinforcement material is an elastomeric material.

4. A roof ridge vent according to claim 1, wherein said nail line reinforcement material extends substantially continuously in a lengthwise direction throughout the length of said mat.

5. A roof ridge vent according to claim 4, wherein said mat has a lengthwise extending centerline hinge whereby, when installed, said mat has an inverted V-shaped transverse cross-section adapted to conform to the roof ridge; and wherein said mat has a pair of opposite and identical lateral flaps extending from said centerline hinge.

6. A roof ridge vent according to claim 5, wherein said nail line reinforcement material includes a pair of separate, spaced apart, parallel strips of material with one of said strips being attached to one of said lateral flaps and said other strip being attached to said opposite lateral flap.

7. A roof ridge vent according to claim 6, wherein said strips of said nail line reinforcement material do not extend across said centerline hinge.

8. A roof ridge vent according to claim 5, wherein said nail line reinforcement material is provided as a strip of material which extends continuously across said centerline hinge onto both lateral flaps of said mat.

9. A roof ridge vent according to claim 1, wherein said air permeable filter material and said nail line reinforcement material are made of the same type of material.

10. A roof ridge vent according to claim 9, wherein said air permeable filter material and said nail line reinforcement material are made of separate strips of fabric.

11. A roof ridge vent according to claim 10, wherein said air permeable filter material and said nail line reinforcement material are formed by a single strip of fabric extending over said apex portions of said cusps and at least a portion of said upper face.

12. A roof ridge vent according to claim 9, wherein at least one of said air permeable filter material and said nail line reinforcement material has a visually perceptible indicator which readily distinguishes said upper face of said mat from a surface of said mat which is intended to confront the roof ridge.

13. A roof ridge vent for installation on a roof overlying an open roof ridge, comprising:

a continuous, indeterminate-length, openwork mat of randomly convoluted polymeric filaments, said mat having an upper face, a lower face, and capable of being rolled lengthwise into a spiral roll during manufacture and unrolled lengthwise in a substantially straight direction during installation on a roof ridge;

a plurality of hollow, openwork spacer elements formed integrally with said mat and projecting from one of said upper face and lower face of said mat whereby, when installed on a roof, said lower face being adapted to confront the roof and said spacer elements being adapted to space said upper face of said mat from the roof and thereby provide a path of ventilation between the roof and a plurality of cap shingles which overlie said vent;

at least one continuous length of air permeable filter material attached to said lower face of said mat for preventing weather and insect infiltration into said ventilation path; and at least one continuous length of nail line reinforcement material attached on said upper face of said mat to reinforce an area of said mat through which nails are adapted to extend to the roof.

14. A roof ridge vent according to claim 13, wherein said mat has a lengthwise extending centerline hinge so that, when installed, said mat has an inverted V-shaped transverse cross-section adapted to conform to the roof ridge; and wherein said mat has a pair of opposite and identical lateral flaps extending from said centerline hinge.

15. A roof ridge vent according to claim 14, wherein said nail line reinforcement material is a fabric bonded to said upper face.

16. A roof ridge vent according to claim 14, wherein said nail line reinforcement material is an elastomeric material.

17. A roof ridge vent according to claim 15, wherein said nail line reinforcement material includes a pair of separate, spaced apart, parallel strips of material such that one of said strips is bonded to one of said lateral flaps, said other strip is bonded to said opposite flap, and neither of said strips extends across said centerline hinge.

18. A roof ridge vent according to claim 16, wherein said nail line reinforcement material is provided as a strip of material which extends continuously across said centerline hinge onto both lateral flaps of said mat.

* * * * *